US006719283B2

(12) United States Patent
Tsuchiya et al.

(10) Patent No.: US 6,719,283 B2
(45) Date of Patent: Apr. 13, 2004

(54) SHEET PUNCHER, SHEET FINISHER EQUIPPED WITH THE SHEET PUNCHER AND IMAGE FORMING APPARATUS USING THE SHEET FINISHER

(75) Inventors: Tsuyoshi Tsuchiya, Hachioji (JP); Toshio Shida, Hachioji (JP); Mikihiro Yamakawa, Hachioji (JP); Hiroyuki Wakabayashi, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/225,384

(22) Filed: Aug. 21, 2002

(65) Prior Publication Data

US 2003/0047858 A1 Mar. 13, 2003

(30) Foreign Application Priority Data

Aug. 29, 2001 (JP) ..... 2001-259481

(51) Int. Cl.[7] ..... B65H 29/58

(52) U.S. Cl. ..... 270/58.07; 271/186; 271/902; 83/156

(58) Field of Search ..... 270/58.07, 58.08; 271/902, 186; 83/156

(56) References Cited

U.S. PATENT DOCUMENTS 5,131,649 A * 7/1992 Martin et al. ..... 271/302
5,720,478 A * 2/1998 Carter et al. ..... 271/186
6,022,011 A * 2/2000 Hirose ..... 270/37
6,042,098 A * 3/2000 Kubota et al. ..... 270/58.02
6,120,015 A * 9/2000 Albright et al. ..... 270/58.07
6,132,352 A * 10/2000 Rider ..... 493/419

FOREIGN PATENT DOCUMENTS

JP 59223646 A * 12/1984 ..... B65H/29/58

* cited by examiner

*Primary Examiner*—Patrick MacKey
(74) *Attorney, Agent, or Firm*—Muserlian, Lucas and Mercanti

(57) ABSTRACT

A sheet puncher includes; a reversal conveying section having a displaceable stopping member by which a sheet is stopped at a predetermined position, and punching device; a conveying-in and conveying-out section having a conveying-in device and conveying-out device by which the sheet is conveyed from a main conveying path into the reversal conveying section, and the sheet is conveyed out from reversal conveying section to the main conveying path, wherein the sheet is conveyed into the reversal conveying section by the conveying-in device, and after the sheet is stopped at a predetermined position by the stopping member, the sheet is punched by the punch device, and the conveying direction is reversed by the stopping member and the sheet is carried from the reversal conveying section by the conveying-out device.

8 Claims, 15 Drawing Sheets

FIG. 10 ( a )
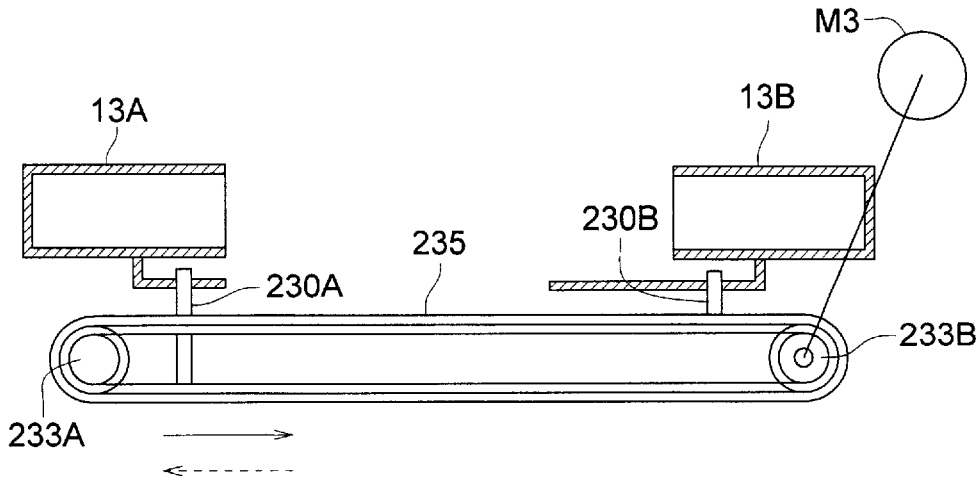
FIG. 10 ( b )
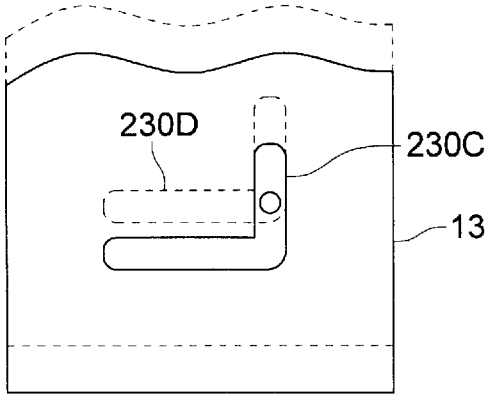

FIG. 12 ( a )
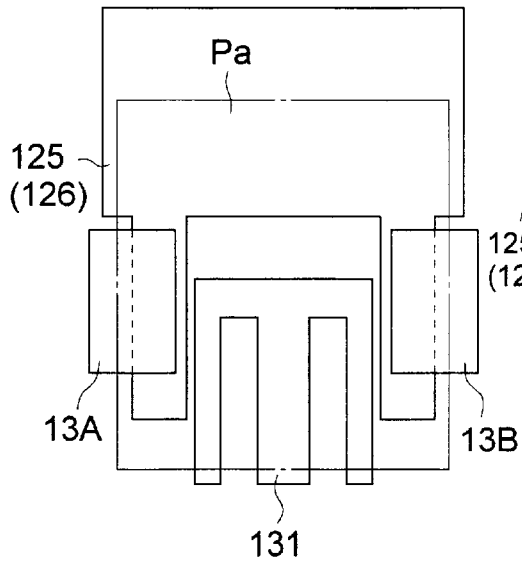
FIG. 12 ( b )
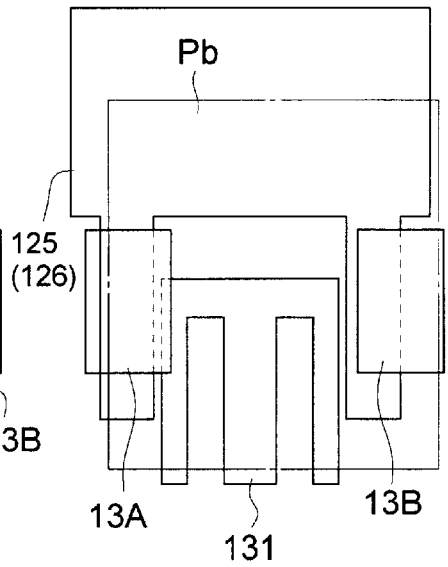

FIG. 14 ( a )
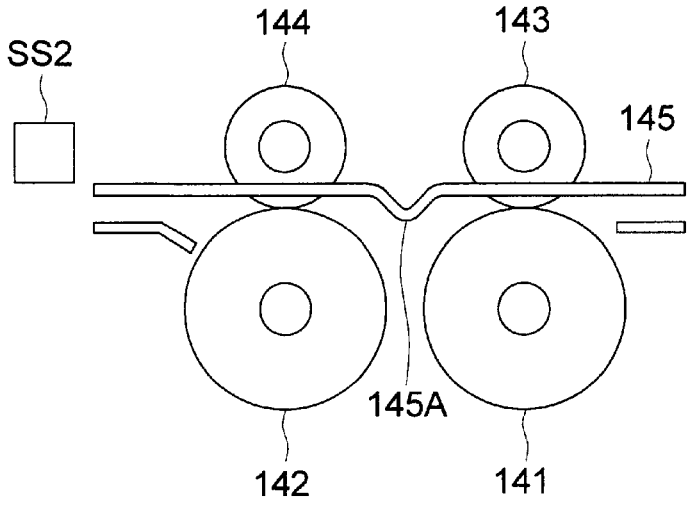
FIG. 14 ( b )
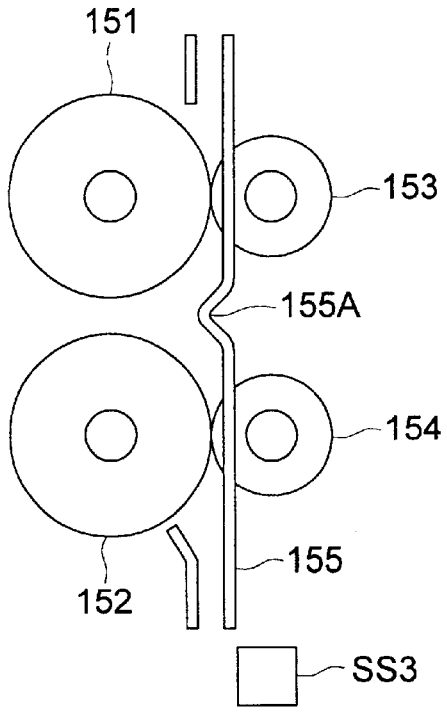

FIG. 15 ( a )
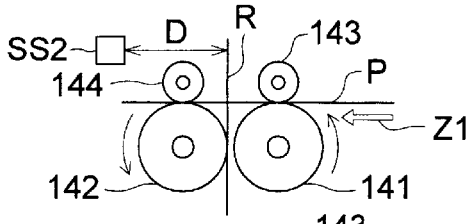
FIG. 15 ( b )
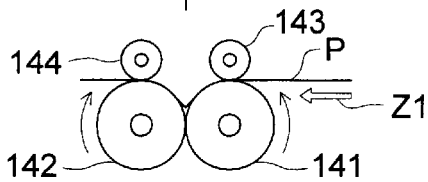
FIG. 15 ( c )
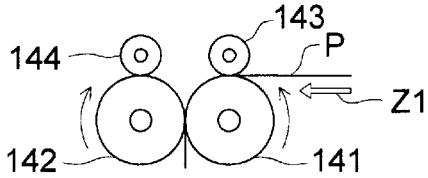
FIG. 15 ( d )
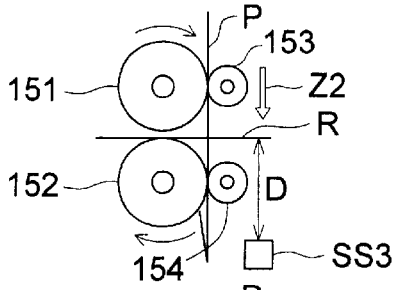
FIG. 15 ( e )
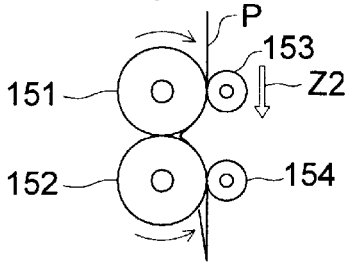
FIG. 15 ( f )
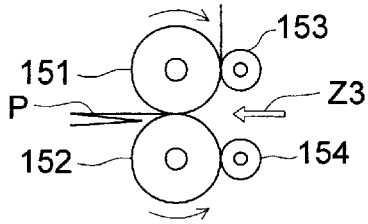

SHEET PUNCHER, SHEET FINISHER EQUIPPED WITH THE SHEET PUNCHER AND IMAGE FORMING APPARATUS USING THE SHEET FINISHER

BACKGROUND OF THE INVENTION

The present invention relates to a sheet puncher to punch sheets, sheet finisher equipped with the sheet puncher and image forming apparatus having the sheet puncher.

Many image forming apparatus are equipped with the sheet finisher to conduct the finish processing such as the sorting, grouping, staple processing, and punch processing on sheets after image formation.

Many sheet finisher have the sheet puncher arranged along a conveying path to an sheet delivery section, and are structured in such a manner that the sheet which is being conveyed is temporarily stopped and punching processing is conducted. Further, in the punch processing, because it is required that a hole is provided at the correct position in the sheet, the alignment of the sheets is conducted prior to the punch processing (for example, Japanese Tokkaihei No. 6-56334).

The conventional sheet puncher is arranged along the conveying path, and for the punch processing, the conveying of the sheet is temporarily stopped. Accordingly, there is a problem that the processing speed of the image forming apparatus or the sheet finisher as an auxiliary apparatus of the image forming apparatus is lowered. Particularly, when the alignment processing of the sheet exists, the processing speed is further lowered. Then, when the processing speed is increased, there is a problem that the punching position becomes incorrect, and results in a trouble for the filing.

SUMMARY OF THE INVENTION

The present invention solves the above problem in the sheet puncher, sheet finisher equipped with the sheet puncher and image forming apparatus and the object of the present invention is to provide the sheet puncher by which the high speed punch processing can be conducted, and the hole can be punched at the correct position, sheet finisher and image forming apparatus.

The object of the preset invention is attained by any one of the following structures (1)–(8).

(1) A sheet puncher which is characterized in that: it is provided with; a reversal conveying section having a displaceable stopping member by which a sheet is stopped at a predetermined position, and punching means; a conveying-in and conveying-out section having a conveying-in means and conveying-out means by which the sheet is conveyed from a main conveying path into the reversal conveying section, and the sheet is conveyed out from reversal conveying section to the main conveying path, wherein the sheet is conveyed into the reversal conveying section by the conveying-in means, and after it is stopped at the predetermined position by the stopping member, it is punch processed by the punch means, and the conveying direction is reversed by the stopping member and the sheet is carried from the reversal conveying section by the conveying-out means.

(2) A sheet puncher according to (1), wherein the reversal conveying section has an alignment means, and after an alignment processing is conducted by the alignment means, the punch processing is conducted.

(3) A sheet puncher according to either one of (1) or (2), wherein the conveying-in and conveying-out section have a conveying-in path, conveying-out path, and guiding means, wherein the guiding means guides the conveying-in direction trailing edge of the sheet from the conveying-in path to the conveying-out path after the sheet is stopped by the stopping member.

(4) A sheet puncher according to any one of (1)–(3), wherein when the preceding sheet exists in the reversal conveying section, and after the conveying-in direction trailing edge of the preceding sheet is guided to the conveying-out path, the conveying-in means conveys the succeeding sheet into the reversal conveying section.

(5) A sheet puncher according to (3), wherein the stopping member is displaced such that the conveying-in direction trailing edge of the sheet is moved to the conveying-out path, and the punching means conducts the punch processing after the displacement of the stopping member.

(6) A sheet puncher according to any one of (1)–(5), wherein the punching means is displaced in according to the sheet size.

(7) A sheet finisher is characterized in that it has a sheet puncher according to any one of (1)–(6).

(8) An image forming apparatus is characterized in that it has a sheet puncher according to any one of (1)–(6).

BRIEF DESCRIPTION OF THE DRAWINGS

FIGS. 10(*a*) and 10(*b*) are sectional views along a line 6—6 in FIG. 6.

FIGS. 12(*a*) and 12(*b*) are views showing a shift operation.

FIGS. 14(*a*) and 14(*b*) are views showing the structure of a folding section.

FIGS. 15(*a*)–15(*f*) are views showing a process of a folding processing.

DETAILED DESCRIPTION OF THE PREFERRED EMBODIMENT

Sheet Reversal Conveying

Figure 1:
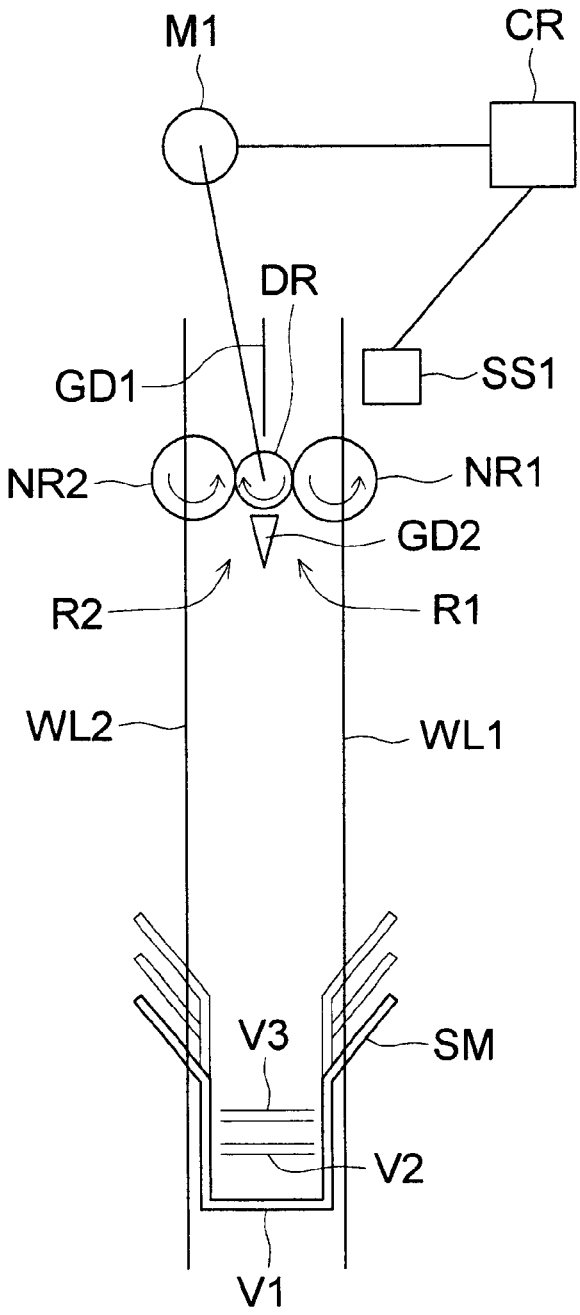
FIG. 1 is a typical view of a sheet reversal apparatus.
Figure 2:
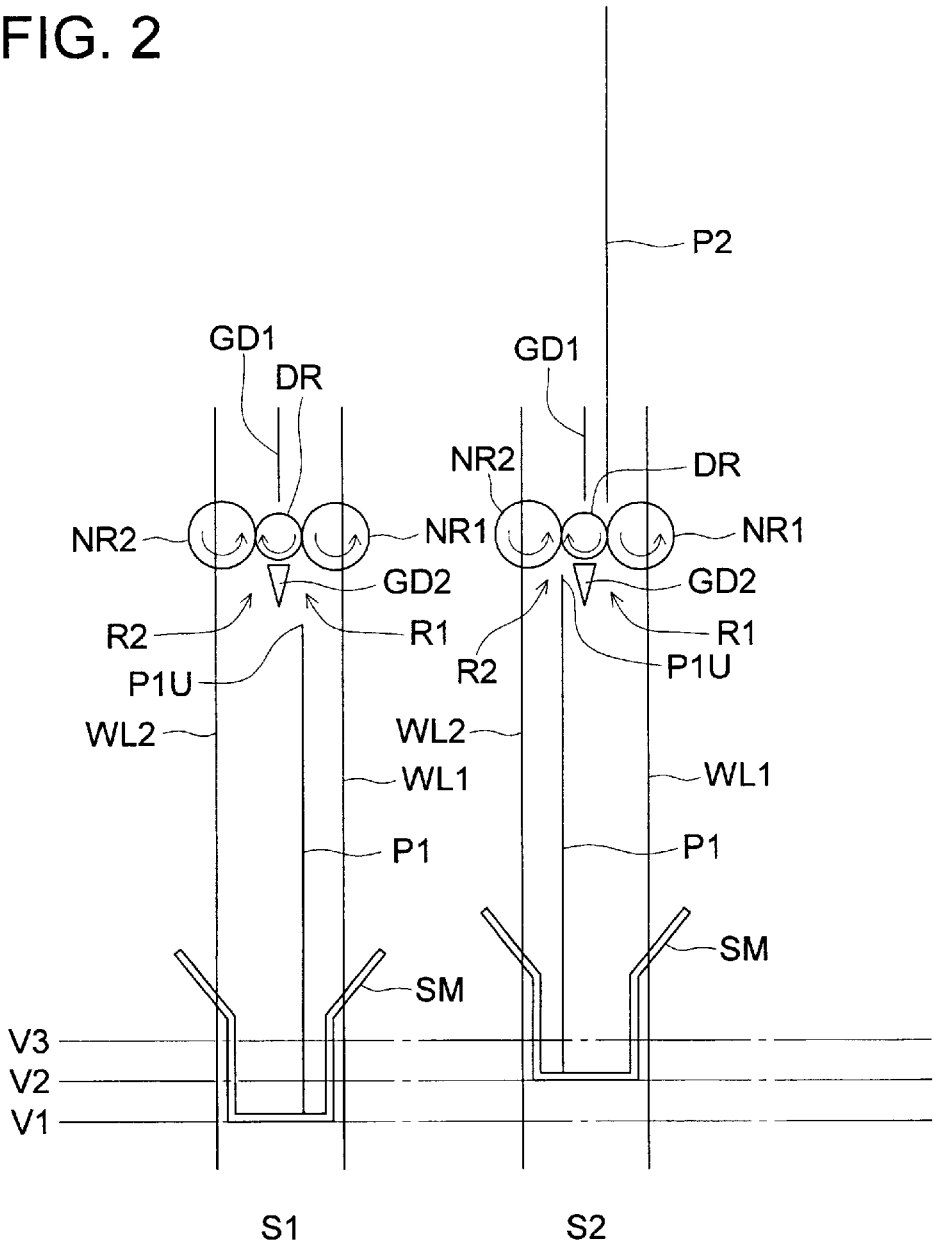
FIG. 2 is a view showing a sheet reversal method.
Figure 3:
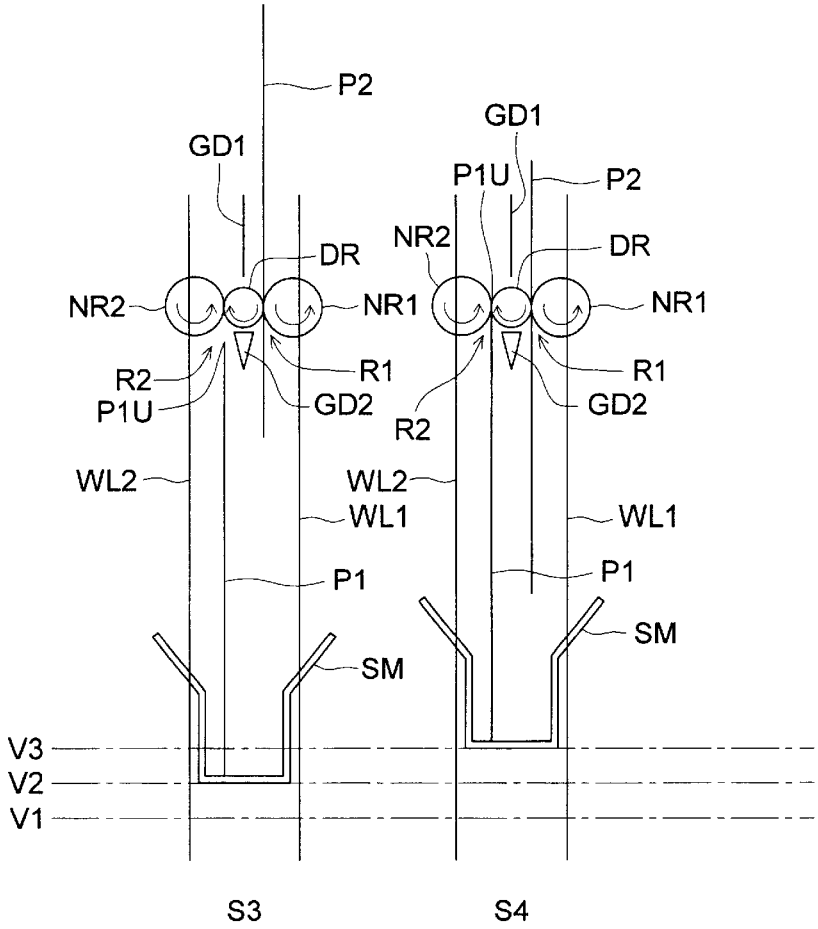
FIG. 3 is a view showing the sheet reversal method.
Figure 4:
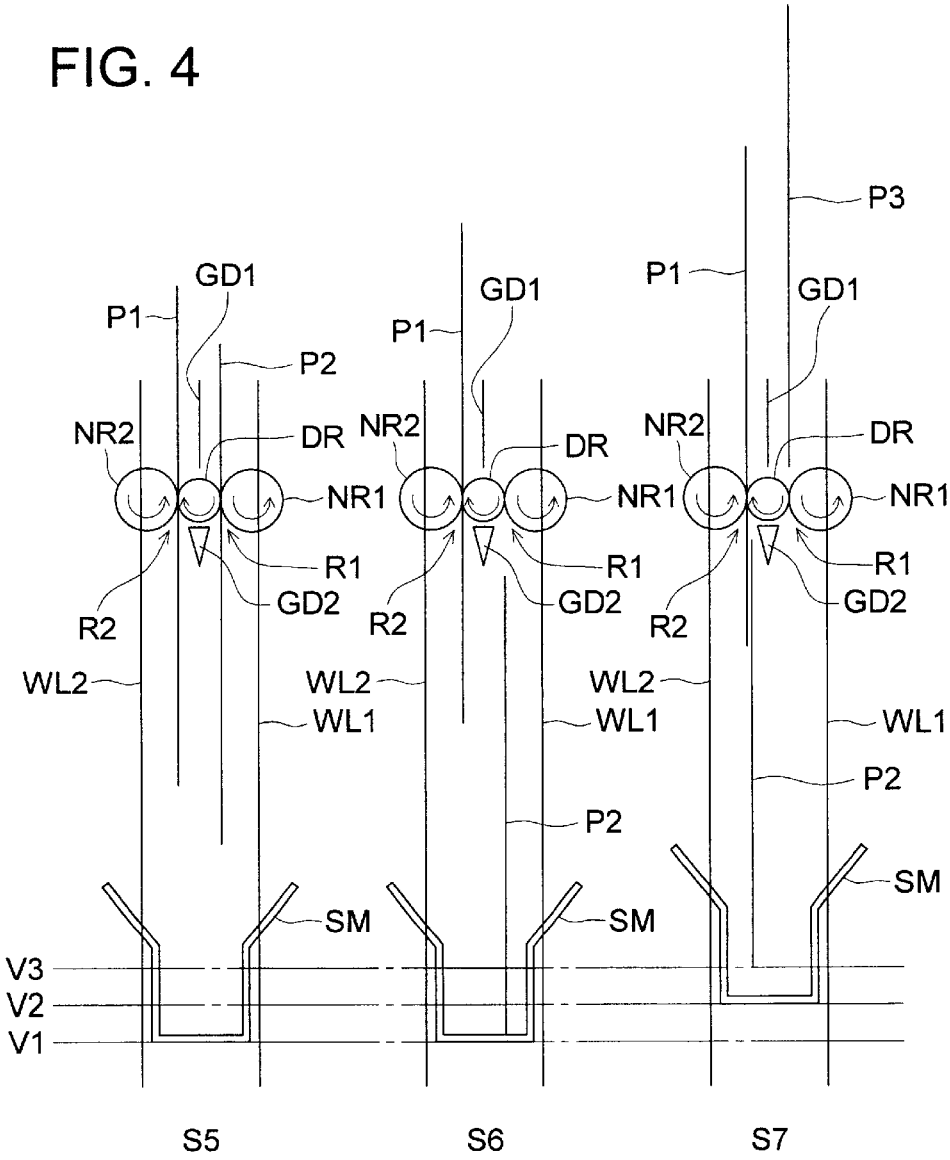
FIG. 4 is a view showing the sheet reversal method.

Referring to FIG. 1 to FIG. 4, initially, a sheet reversal apparatus and a sheet reversal method according to an embodiment of the present invention will be described below. FIG. 1 is a typical view of a sheet reversal apparatus according to an embodiment of the present invention, and FIGS. 2–4 are views showing a sheet reversal method according to the embodiment of the present invention.

The sheet reversal apparatus according to the present embodiment is provided with a drive roller DR, follower rollers NR1, NR2, two parallel guide plates WL1, WL2, guide members GD1, GD2, and stopping member SM. The guide plates WL1, WL2 and stopping member SM structure a reversal conveying section by which the sheet is switch-back conveyed, and the drive roller DR as the first drive roller and the drive roller NR1 as the first follower roller structure a conveying-in means for conveying the sheet into the reversal conveying section, and the drive roller DR as the second drive roller and follower roller NR2 as the second follower roller structure a conveying-out means for conveying out the sheet from the reversal conveying section.

The drive roller DR is driven clockwise in the drawing as an arrow, and conveys the sheet into the reversal conveying section and conveys out the sheet from the reversal conveying section.

The guide plates WL1, WL2 accommodate the conveyed-in sheet, guide member DG1 guides the sheet at the time of the conveying-in and conveying-out of the sheet, and guide member GD2 divides the conveying-in path R1 and conveying-out path R2, and guides so that the preceding sheet and the succeeding sheet do not collide with each other.

In the present embodiment, the front and rear of the sheet are reversed when, after the sheet is conveyed between the guide plates WL1 and WL2, the sheet is switch backed and conveyed.

Stages S1–S7 in FIGS. 2–4, show various stages in the process by which a plurality of sheets are reversed and conveyed.

In a conveying-in stage S1 of a first sheet P1, the sheet P1 is conveyed in by the drive roller DR and follower roller NR1, and the sheet P1 is dropped to the stopping member SM. The stopping member SM is set at the first position V1 at which the upper end (conveying-in direction trailing edge) P1U of the sheet P1 is lower than the lower end (guide end) of the guide member GD2.

In the stage S2, the stopping member SM is set at the second position V2 by which the upper end P1U of the sheet P1 is elevated to the upper portion than the lower end (guiding end) of the guiding member GD2. By the elevation of the stopping member SM in the stage S2 to the second potion V2, the upper end P1U of the sheet P1 is withdrawn from the conveying-in path R1 to the conveying-out path R2.

Such the introduction to the conveying-out path R2 of the upper end P1U of the sheet P1 is realized by the shape of the conveying-in path R1, guiding member GD2 and conveying-out path R2 as will be described later. Further, by the movement such as the rotation of the guiding member GD2, the upper end P1U can also be introduced to the conveying-out path R2.

The stage S3 is a stage in which the upper end P1U is introduced to the conveying-out path R2, and in this stage, the second sheet P2 is conveyed in by the drive roller DR and follower roller NR1.

In the next stage S4, the stopping member SM is elevated and the upper end P1U (leading edge in the conveying-out direction) of the preceding first sheet P1 is nipped between the drive roller DR and follower roller NR2. While it is moved from the stage S3 to the stage S4, the succeeding sheet P2 is conveyed, and runs between the guiding palates WL1 and WL2 toward the lower portion as shown in the drawing.

In the next stage S5, the stopping member SM is lowered to the first position. During this time, the sheet P1 is continuously conveyed, and as shown in the drawing, runs toward the upper portion, and the sheet P2 runs toward the lower portion.

The stage S6 is a stage in which the upper end (trailing edge in the conveying-in direction) of the sheet P2 is separated from the drive roller DR and follower roller NR1 and dropped, and supported by the stopping member SM, and the stage S6 is equal to the stage S1.

Next, the third sheet P3 is conveyed in. In the stage S7 in which the conveying-in of the sheet P3 is started, two sheets P1 and P2 simultaneously run inside the reversal conveying section, that is, on the passage between the guiding plates WL1 and WL2, as shown in the drawing.

As can be clearly seen from the above description, by repeating the reversal conveying process from the stages S1 to S5, the reversal conveying of many sheets P is conducted.

In the an above-described reversal conveying process, the drive roller DR is continuously driven by a stepping motor M1 and continuously rotated clockwise. Then, the stopping member SM is driven by a stepping motor M2 and displaced to the first to third position V1–V3. The control of the displacement of the stepping member SM is conducted by a control means CR according to a leading edge detection signal of the sheet outputted by a detection means SS1 arranged at the upstream, or desirably, in the vicinity of the upstream of the conveying-in means composed of the drive roller DR and follower roller NR1, and the stopping member SM is displaced as described above to the first to third position V1–V3 in a predetermined time period from the leading edge detection by the detection means SS1.

Image Forming Apparatus

Next, the image forming apparatus equipped with the sheet reversal apparatus will be described. In the image forming apparatus shown in FIG. 5, the sheet reversal apparatus is provided in the finisher B. In this connection, the sheet reversal apparatus may also be provided in the sheet delivery section or re-conveying section 8 of the image forming apparatus main body A.

Figure 5:
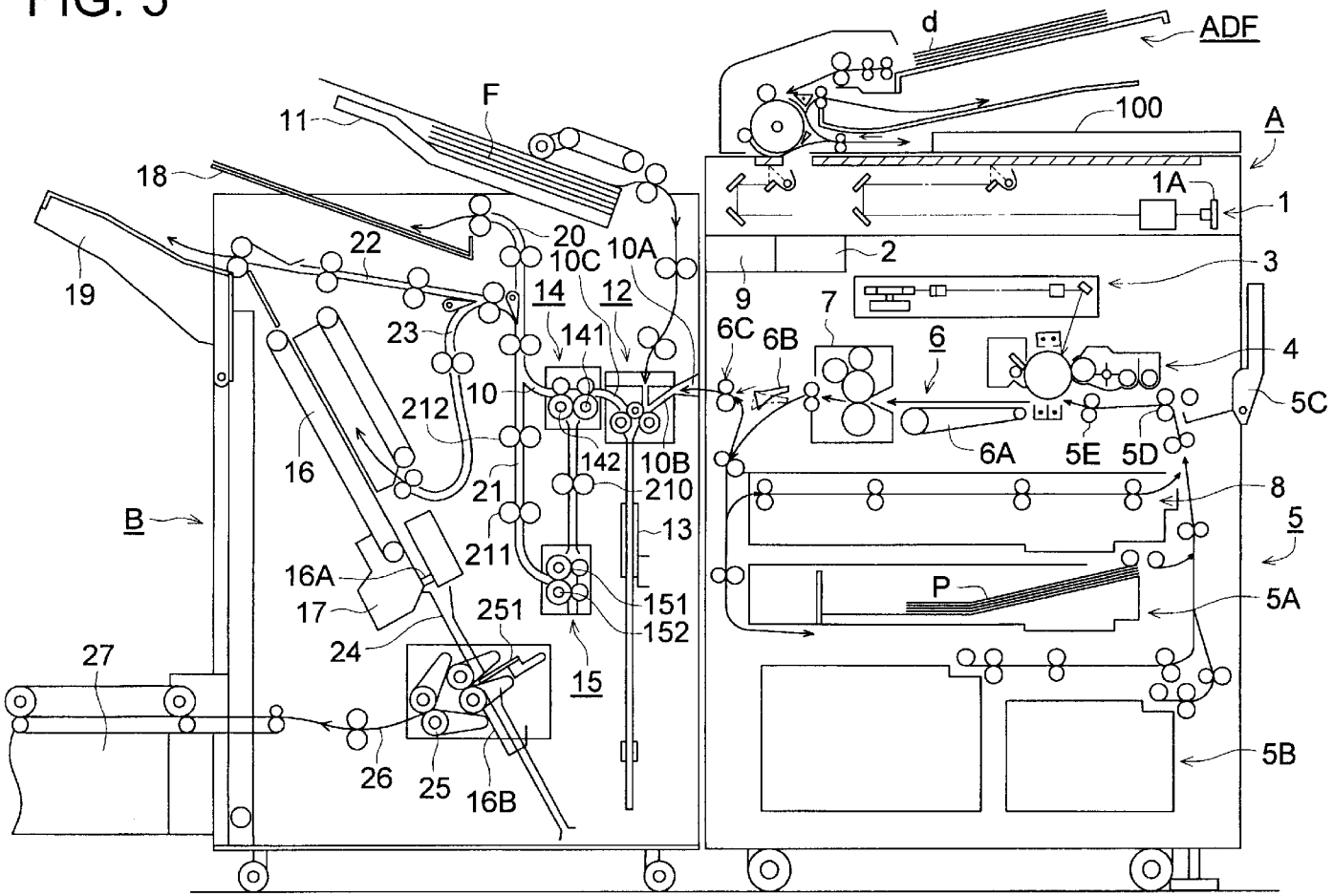
FIG. 5 is a view showing an image forming apparatus according to an embodiment of the present invention.

FIG. 5 shows the image forming apparatus according to the embodiment of the present invention, and the image forming apparatus is composed of the image forming apparatus main body A, automatic documents feeder ADF and finisher B.

The image forming apparatus main body A shown in the drawing has an image reading means 1, image processing means 2, image writing means 3, image forming means 4, sheet feeding means 5, conveying means 6, fixing means 7, re-conveying means (automatic double sided copy conveying section ADU) 8 and control means 9.

The sheet feed means 5 is composed of a cassette sheet feed section 5A, large capacity sheet feed tray (LCT) 5B, manual sheet feed section 5C, intermediate sheet feed roller 5D and register roller 5E.

The conveying means 6 has a conveying belt 6A, conveying path switching plate 6B, and sheet delivery roller 6C.

In the upper portion of the image forming apparatus main body A, an automatic document feeder ADF is mounted. On the sheet delivery roller 6C side on the left side surface, shown in the drawing, of the image forming apparatus main body A, the finisher B is connected.

The document d placed on the document table of the automatic document feeder ADF is conveyed in the arrowed direction, an image of a single side or double sides of the document is read by an optical system of the image reading means 1, and read in a CCD image sensor 1A.

An analog signal which is photoelectric converted by the CCD image sensor 1A sends a signal to the image writing means 3, after it is analog processed, A/D converted, shading corrected, and image compression processed in the image processing means 2.

In the image writing means 3, the output light from the semiconductor laser is radiated on a photoreceptor drum of the image forming means 4, and a latent image is formed. In the image forming means 4, a processing such as a charging, exposing, developing, transferring, separation, and cleaning is conducted. Onto the sheet P conveyed from the sheet feeding means 5, the image is transferred in the transfer section.

The sheet P on which the image is carried, is conveyed by a conveying belt 6A, fixing processed by the fixing means 7, and sent from the sheet delivery roller 6C into a sheet introduction section 10A of the finisher B. Or, the sheet P which is one side image processed, conveyed into the re-conveying means 8 by the conveying path switching plate 6B is, in the image forming means 4 again, after it is double-sided image processed, delivered from the sheet delivery roller 6C. The sheet P delivered from the sheet delivery roller 6C is sent into the finisher B.

The finisher B has the sheet introduction section 10A which receives the sheet P after the image recording is completed, sheet feeding apparatus 11 by which the additional sheet F is fed, reversal conveying section 13 as the reversal conveying section, folding sections 14 and 15; intermediate tray 16, stapling section 17, center folding section 25, fixed sheet delivery tray 18, vertically movable elevation sheet delivery tray 19, and fixed sheet delivery section 27, wherein these components are connected by conveying paths 10, 20, 21, 22, 23 and 24.

The sheet reversal apparatus shown in FIG. 1 is provided in the finisher B of the image forming apparatus of FIG. 5, or in the re-conveying means 8.

The finisher B conducts the finish processing in the following processing modes.

(1) A Simple Sheet Delivery Mode

The sheet P introduced from the sheet introduction section 10A is simply delivered in the order of introduction. In this mode, the sheet P is delivered onto the fixed sheet delivery tray 18 through the conveying paths 10 and 20.

(2) A Shift Mode

The sheet P is delivered by changing the sheet delivery position for each volume of a plurality of sheets. In this mode, the sheet P is conveyed from the sheet introduction section 10A into the reversal conveying section 13 as the reversal conveying section, and as will be described later, after the sheet P is shift processed in the reversal conveying section 13, the sheet P is returned to the conveying path 10 as the main conveying path, and delivered onto the elevation sheet delivery tray 19 though the conveying paths 10 and 22.

(3) A Folding Mode

The sheet P is folded at one or two portions and a two folding process or three folding process is conducted, and then the sheet P is delivered.

The sheet P introduced from the sheet introduction section 10A is conveyed to the folding sections 14 and 15 and after the sheet P is folding-processed at the first and the second folding sections, it is delivered onto the elevation sheet delivery tray 19 through the conveying path 10 and conveying path 22. There are a case where the sheet p is tree-folding processed by the first and second folding sections, and a case where, by using only the folding section 14, the sheet P is two-folding processed. Further, previous to the folding processing, it is desirable that the alignment processing is conducted in the reversal conveying section 13.

(4) A Stapling Mode

For each of a plurality of sheets P, the stapling processing is conducted and the sheet P is delivered.

After a predetermined number of sheets P conveyed from the conveying path 10 to the conveying path 23 are stacked on the intermediate tray 16, staple processed in the stapling section 17, and after the staple processing, the sheets are delivered onto the elevation delivery sheet tray 19. Further, prior to the folding processing, it is desirable that the alignment processing is conducted in the reversal conveying section 13.

(5) A Mode in Which the Folding Mode Mentioned Above (3) and the Staple Mode Mentioned Above (4) are Combined and the Sheet P is Processed (6) A Center-folding Mode The central portion of the sheet P is staple processed protruded member 251, the center-folding processing is conducted, and the sheet P is delivered onto the fixed sheet delivery section 27.

In the above each mode, when the additional sheet F is fed from the sheet feed tray 11, and adds it to the sheet P fed from the image forming apparatus main body A, for each bundle of the sheet P, the book cover, back cover, and partition sheet can be added.

Next, referring to FIG. 6 which is a sectional view of the conveying-in and conveying-out section 12 and reversal conveying section 13, the structure of the conveying-in and conveying-out section 12 and the reversal conveying section 13 will be described.

The conveying-in and conveying-out section 12 conveys the sheet P1 from the conveying-in path 10B into the reversal conveying section 13, and conveys it out from the reversal conveying section 13 to the conveying-out path 10C.

The reversal conveying section 13 conducts reversal conveying processing, punch processing, alignment processing and shift processing. The conveying-in and conveying-out section 12 conveys the sheet P1 from the conveying-in path 10B into the reversal conveying section 13, and conveys it out from the reversal conveying section 13 to the conveying-out path 10C. The conveying-in and conveying-out section 12 is composed of an upper side guide member 124, lower side guide members 125B and 126B, drive roller 122 driven by the stepping motor M1, and follower rollers 121 and 123, wherein the conveying-in and conveying-out section 12 has the conveying-in path 10B formed of the upper side guide member 124 and the lower side guide member 125B, and the conveying-out path 10C formed of the upper side guide member 124 and the lower side guide member 126B.

The drive roller 122 as the first drive roller and the follower roller 121 as the first follower roller structure the conveying-in means, and the drive roller 122 as the second drive roller, and the follower roller 123 as the second follower roller structure the conveying-out means. A protrusion 124A of the upper side guide member 124 as the guide member partitions the conveying-in path 10B and the conveying-out path 10C.

Vertical portions which are parallely opposite to each other, of the guide plates 125 and 126, structure the sheet accommodation section having the passage 129, and further the upper portion opened to the upper side of the guide plates 125 and 126 structures the lower side guide members 125B and 126B, and as described above, it forms the conveying-in path 10B and the conveying-out path 10C of the sheet P1.

The upper side guide member 124 has the protrusion 124A as the guide member at its lower end. The leading edge Q of the protrusion 124A is set as shown by the vertical line L drawn at the leading edge Q in such a manner that it positions on the conveying-in path 10B side from the vertical parallel portion (sheet accommodation portion) of the guide plate 125. By such the shape of the protrusion 124A, in the sheet P1 conveyed in from the conveying-in path 10B, its upper end portion is separated from the nip portion of the drive roller 122 and follower roller 121 and drops, and when it is supported by the stopping member 131, it is surely moved from the conveying-in path and guided to the conveying-out path 10C.

Figure 6:
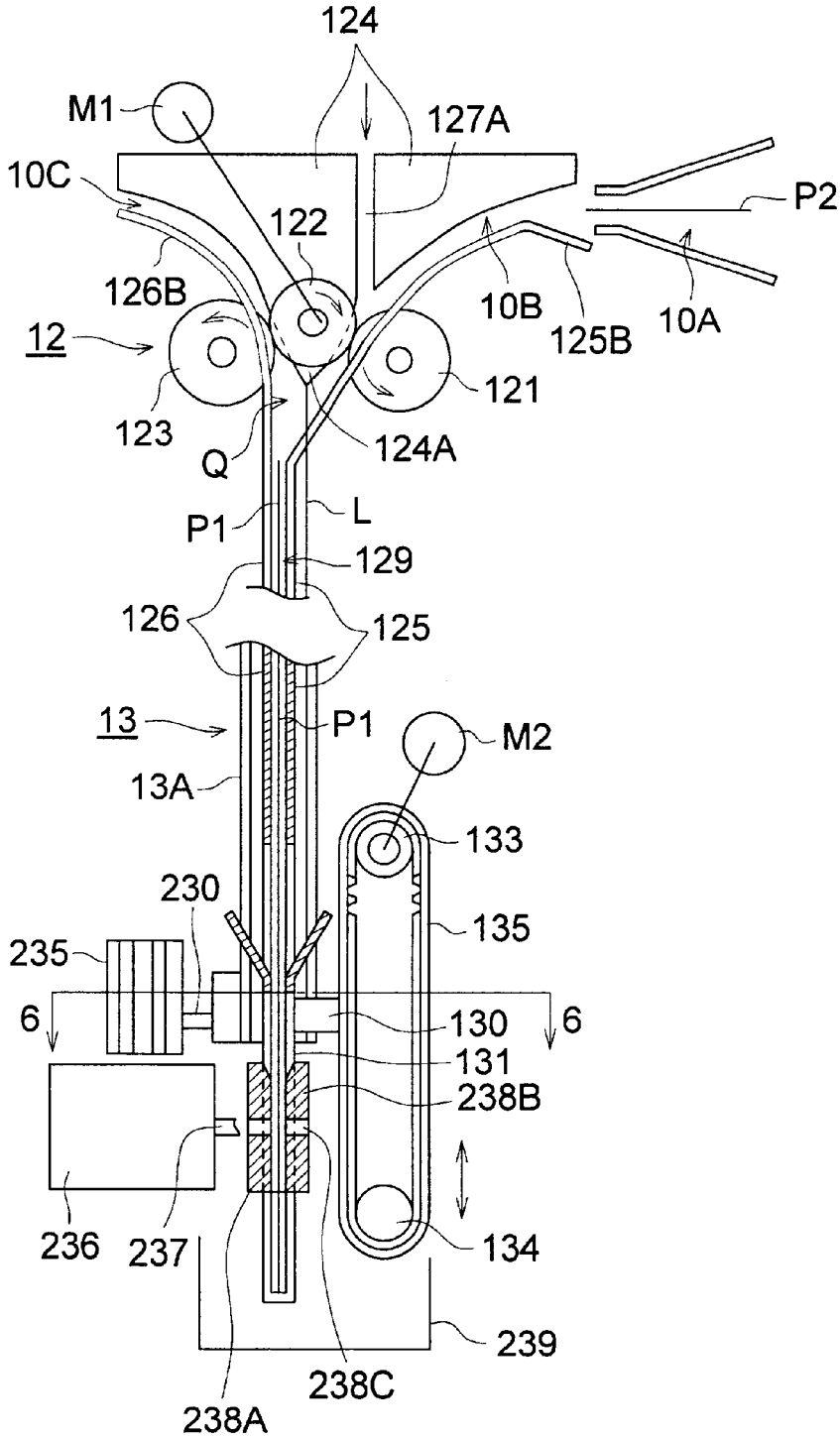
FIG. 6 is a sectional view of a conveying-in and conveying-out section and reversal conveying section.
Figure 7:
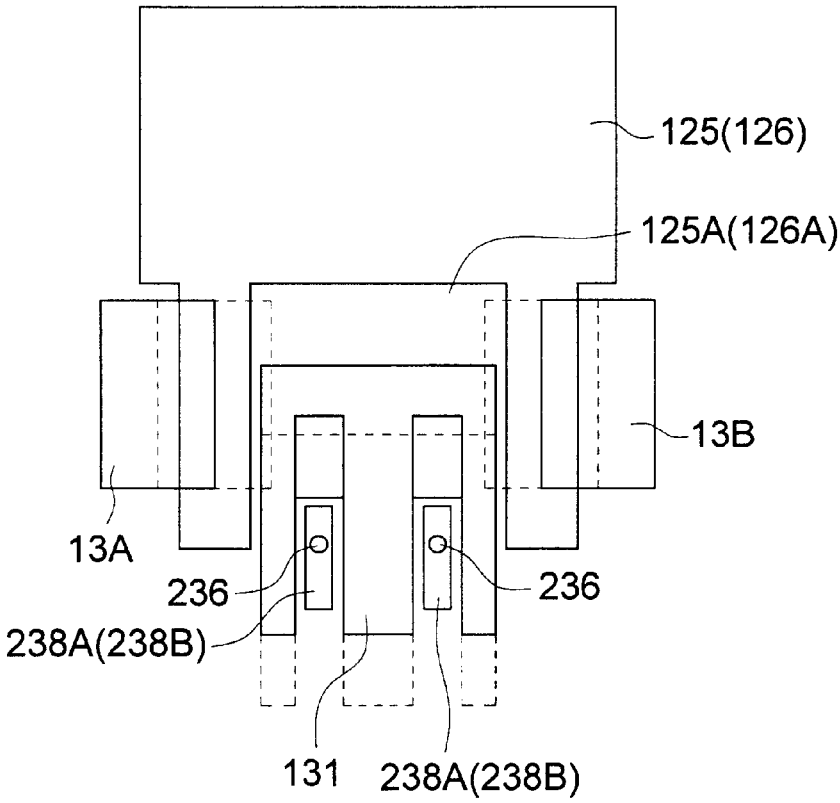
FIG. 7 is a side view of the reversal conveying section.

As shown in FIG. 7, in the guide plates 125 and 126, cutout portions 125A and 126A are formed in the central portion of the conveying path width direction. As shown in FIG. 7, in the cutout portions 125A and 126A, the stopping member 131 having an introduction portion opened upwardly as shown in FIG. 6, is provided. The stopping member 131 is connected to a teethed belt 135 by the connection member 130, and driven by the stepping motor M2 and moved upward and downward. The stopping member 131 takes the first to the third positions V1–V3, as will be described later, and the first to the third positions V1–V3 are changed in accordance with the sheet size.

On both sides of the conveying path width direction of the guide plates 125 and 126, regulation members 13A and 13B which are alignment means as side edge regulation members are provided.

Numeral 236 is a solenoid to drive a punch pin 237 as the punch means, and the punch pin 237 is driven and the punching processing to make a hole at a predetermined position of the sheet P1 is conducted. The punch guides 238A and 238B hold the sheet to be punch-processed sandwiching the passage 129, and has a guide hole to guide the reciprocating motion of the punch pin 237. In the punch processing, the sheet P1 is held by the punch guides 238A and 238B composed of a pair of guide plates, and the punch processing is conducted at a correct position. A paper scrap generated by the punching processing is collected in the collection box 239. The hole 238C for the punch pin 237 is provided in the punch guides 238A and 238B. The solenoid 236, punch guides 238A, 238B and the punch pin 237 structure a punching unit, and the punching unit is displaced upward and downward in accordance with the sheet size.

Next, various processings conducted in the reversal conveying section 13 will be described, and in the following description, FIGS. 1–4 showing the reversal conveying processing process are referred together. In this connection, in the following description, the reversal conveying processing is described as the narrow meaning reversal conveying processing which does not conduct the alignment processing or shift processing but conducts only reversal conveying, and the sheet reversing apparatus and the sheet reversal method according to the present embodiment are, other than the reversal conveying processing which is not accompanied by the alignment processing or shift processing, an apparatus and method by which the wide meaning reversal conveying including the reversal conveying processing accompanied by other processings such as the processing to conduct the reversal conveying while the alignment processing is conducted, and the processing to conduct the reversal conveying while the shift processing is conducted, is conducted.

Reversal Conveying Processing

Figure 8:
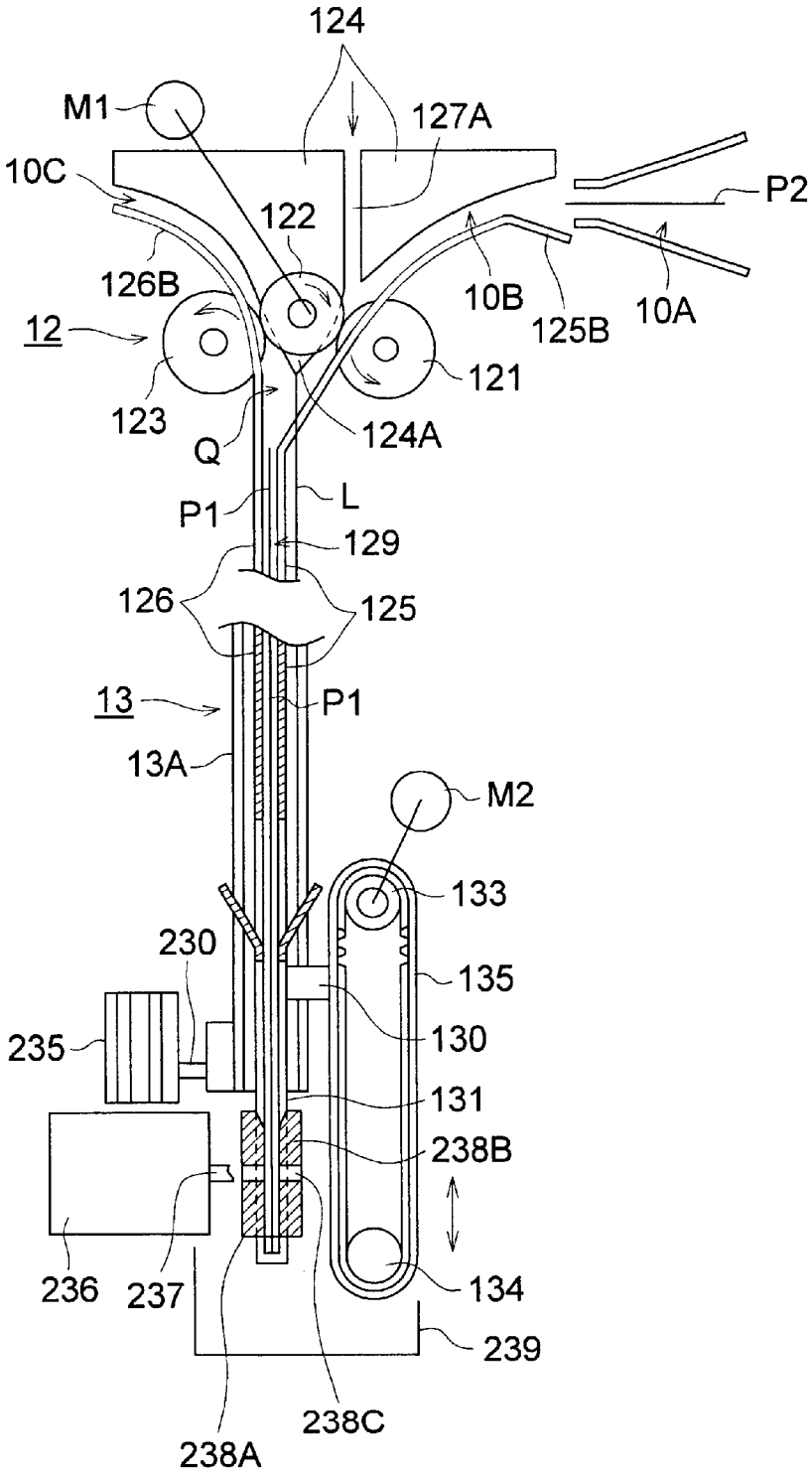
FIG. 8 is a sectional view of the conveying-in and conveying-out section and reversal conveying section in a preceding sheet withdrawal process.
Figure 9:
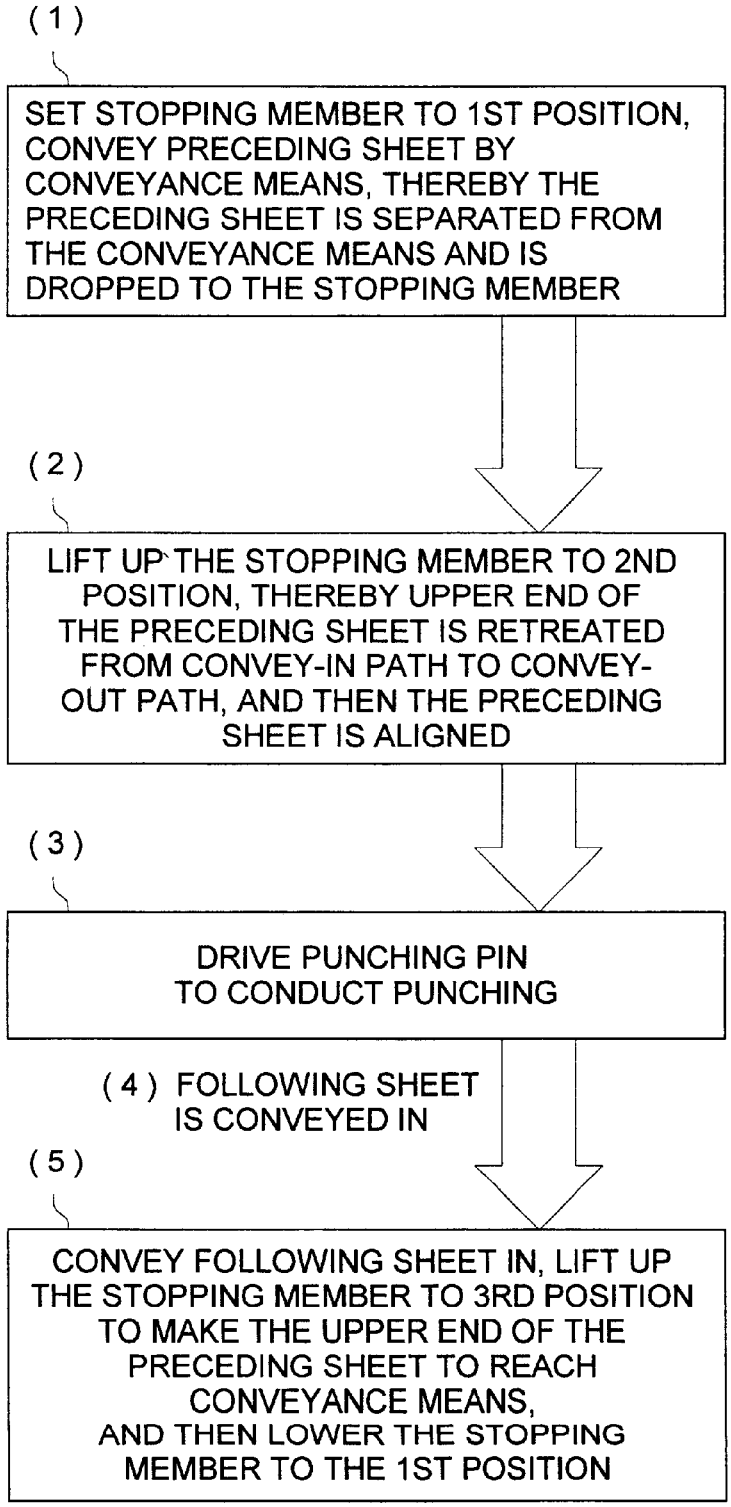
FIG. 9 is a view showing a process of an alignment processing and punch processing.
Figure 11:
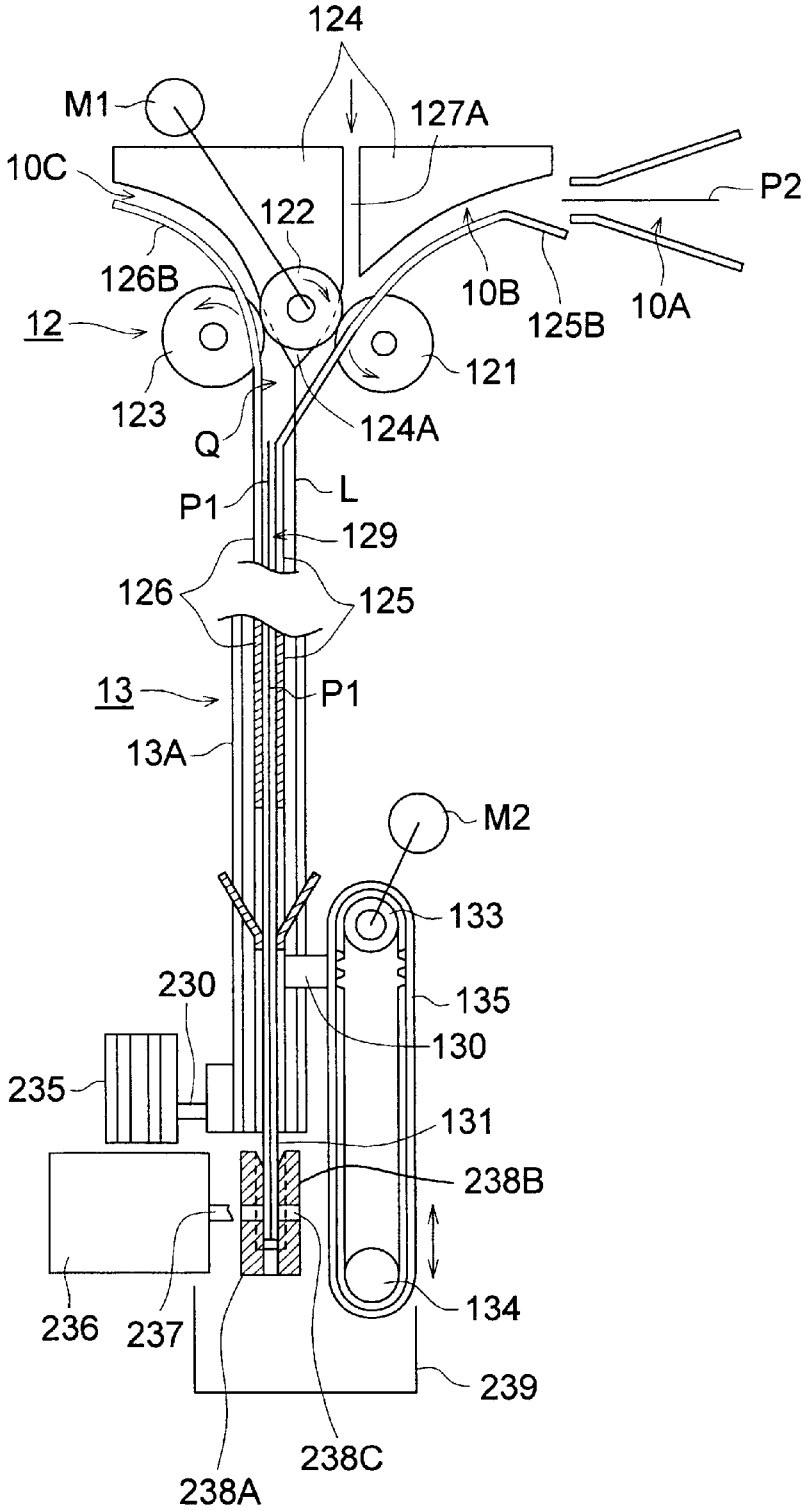
FIG. 11 is a sectional view of the conveying-in and conveying-out section and reversal conveying section in a preceding sheet conveying-out process.

Referring to FIGS. 1–4, 6, 8, and 11, the reversal conveying processing will be described. The reversal conveying processing is conducted in the previously described process by referring to FIGS. 2–4. FIG. 6 is a sectional view of the conveying-in and conveying-out section 12 and the reversal conveying section 13, FIG. 7 is a side view of the reversal conveying section 13, FIG. 8 is a sectional view of the conveying-in and conveying-out section 12 and the reversal conveying section 13 in the preceding sheet withdrawal process, FIG. 9 is a view showing a process of the alignment processing and punching processing, FIGS. 10(*a*) and 10(*b*) are sectional views of the reversal conveying section 13 along a line 6—6 in FIG. 6, and FIG. 11 is a sectional view of the conveying-in and conveying-out section 12 and the reversal conveying section 13 in the preceding sheet conveying-out process.

Each component in FIG. 6 corresponds to the component in FIG. 1 as shown in Table 1.

TABLE 1

| FIG. 1 | FIGS. 6 and 7 |
|---|---|
| Drive roller DR | Drive roller 122 |
| Follower rollers NR1, NR2 | Follower rollers 121, 123 |
| Guide member GD2 | Protrusion 124A |
| Conveying-in path R1 | Conveying-in path 10B |
| Conveying-out path R2 | Conveying-out path 10C |
| Stopping member SM | Stopping member 131 |
| Guide plates WL1, WL2 | Parallel portion of guide plates 125, 126 |

Each portion shown in Table 1 continuously reversal conveys the sheet through each of stages S1–S7 in FIGS. 2–4 as will be described below.

In the conveying-in stage of the first sheet P1, the sheet P1 is conveyed in by the drive roller 122 and the follower roller 121, and is dropped to the stopping member 131. FIG. 6 shows the condition that the conveying-in stage is completed and the sheet P1 is supported by the stopping member 131, and corresponds to S1 in FIG. 2. The stopping member 131 is set to the first position V1 at which the upper end (conveying-in direction trailing edge) P1U is lower than the lower end Q (guide end) of the protrusion 124A as the guide member.

In the stage S2, the stopping member 131 is set to the second position V2 at which the upper end P1U of the sheet P1 is elevated to the upper portion than the lower end Q of the protrusion 124A. By the elevation to the second position V2 of the stopping member 131 in the stage S2, the upper end P1U of the sheet P1 is withdrawn from the conveying-in path 10B and conveyed to the conveying-out path 10C.

Such the introduction to the carrying-out path 10C of the upper end P1U of the sheet P1 is surely conducted by the shape of the conveying-in path 10B, protrusion 124A and conveying-out path 10C. Alternatively, by the movement of the protrusion 124A, the upper end P1U can also be introduced to the conveying-out path 10C.

The stage S3 in FIG. 3 is a stage in which the upper end P1U is introduced to the conveying-out path 10C, and in the stage S3 in which the stopping member 131 is in the second position V2, the second sheet P2 is conveyed in by the drive roller 122 and follower roller 121.

In the next stage S4, the stopping member 131 is elevated to the third position V3, and the upper end P1U (leading edge in the conveying-out direction) of the sheet P1 is nipped between the drive roller 122 and follower roller 123. During the transfer from the stage S3 to the stage S4, the sheet P2 is conveyed and runs downward on the passage 129 as shown in the drawing.

In the next stage S5 in FIG. 4, the stopping member 131 is lowered to the first position V1. During this, the sheet P1 is continuously conveyed and runs upward as shown in the drawing, and the sheet P2 runs downward.

The stage S6 is a stage in which the upper end (trailing edge in the conveying-in direction) of the sheet P2 drops separated from the drive roller 122 and follower roller 121, and is supported by the stopping member 131. The stage S6 which is a second sheet P2 conveying-in stage, is equal to S1 which is the conveying-in stage of the first sheet.

In the stage S7 in which the third sheet P3 reaches the entrance of the reversal conveying section 13, the three sheets P1, P2 and P3 simultaneously run in the reversal conveying section 13.

As clearly be seen from the above description, by repeating the reversal conveying process from the stage S1 to the stage S5, the reversal sheet delivery of many number of sheets is conducted.

Alignment Processing and Punch Processing

Next, referring to FIGS. 6-11, the alignment operation in the reversal conveying section 13 will be mainly described.

The alignment processing is a processing by which, onto the side end of the sheet P accommodated in the reversal conveying section 13, as shown in FIG. 7, the sheet P is adjusted with the normal position of the central portion when the regulation members 13A and 13B are provided with the displacement action in the conveying path width directions which are opposite to each other.

The alignment processing is conducted through a process shown in FIG. 9. FIG. 9 shows the sheet alignment method according to the embodiment of the present invention.

(1) Preceding Sheet Conveying-in Process:

The drive roller 122 is rotated clockwise, and the preceding sheet P1 is conveyed in from the conveying path 10B. In the preceding sheet conveying-in process, the stopping member 131 set to the first position V1 at which the upper end (trailing edge in the conveying-in direction) of the preceding sheet P1 is separated from the nip between the follower roller 121 and drive roller 122, and in the lowest position, and because the preceding sheet P1 is separated from the drive roller 122 and the follower roller 121, it is dropped and supported by the stopping member 131 and is stopped.

(2) Preceding Sheet Withdrawal Process, and Alignment Process:

The stopping member 131 is elevated to the second position V2, that is, to the position at which the upper end (trailing edge in the conveying-in direction) of the sheet is upper than the guide end Q of the protrusion 124A. In the elevation process of the stopping member 131, the upper end of the preceding sheet P1 is, because the guide end Q of the protrusion 124A is positioned on the side of the conveying-in path 10B from the vertical line L, securely withdrawn from the conveying-in path 10B to the conveying-out path 10C.

A condition of the reversal conveying section 13 in which the stopping member 131 is elevated to the second position is shown in FIG. 8. In the condition of FIG. 8, the alignment of the preceding sheet P1 in the conveying path width direction is conducted. Referring to FIGS. 10(*a*) and 10(*b*) which are sectional views along the line 6–6 in FIG. 6, mainly the alignment operation will be described.

The regulation members 13A and 13B are respectively driven by pins 230A and 230B, and reciprocally moved between a position shown by a solid line, and a position shown by a dotted line in FIG. 7. The pin 230A is fixed onto a toothed belt 235 trained around the follower roller 233A and the drive roller 233B, and fixed onto the regulation member 13A. The pin 230B is fixed onto the toothed belt 235 in a side portion opposite to the combination side portion of the pin 230A of the toothed belt 235, and the regulation member 13B is engaged with the regulation member 13A through a longitudinal long hole 230C and lateral long hole 230D provided in its combination portion 132. The toothed belt 235 is driven by the stepping motor M3 in the alignment process, and reciprocally moved as shown by a solid line arrow and dotted line arrow.

The regulation member 13B can be moved upward and downward as shown in FIG. 10(*b*), and in the alignment process, the combination portion 132 is set to a lowered position shown by a solid line in FIG. 10(*b*), and the pin 230B is positioned in the longitudinal long hole 230C, and the movement of the pin 230B is transmitted to the regulation member 13B.

When the toothed belt 235 is driven by the stepping motor M3 and is reciprocally moved as shown by an arrow in the alignment process, the regulation members 13A and 13B are reciprocally moved in the opposite direction to each other, and the side ends of the sheet P are regulated, and the preceding sheet P1 is aligned at an almost central position on the conveying path.

In this connection, the movement range at the time of alignment of the regulation members 13A and 13B is set to the range in accordance with the sheet size by the control of the stepping motor M3.

In the elevation operation to the second position and the alignment operation of the stopping member 131, either one may be conducted earlier between the two, or may be conducted simultaneously.

(3) Punching Process:

After the stopping member 131 completes the alignment at the height shown in FIG. 8, the solenoid 236 is operated and drives the punch pin 237, and makes a hole in the lower portion of the preceding sheet P1. When the punch processing is completed, the punch pin 237 is withdrawn.

(4) Succeeding Sheet Conveying-in Process:

After the withdrawal from the conveying-in path 10B of the preceding sheet by the elevation to the second position V2 of the stopping member 131, alignment processing and punch processing, the conveying-in of the succeeding sheet P2 is conducted. That is, by the clockwise rotation of the drive roller 122, the succeeding sheet P2 is conveyed in. In the conveying-in process, because the upper end (leading edge in the conveying direction) of the preceding sheet P1 is withdrawn from the conveying-in path as described above, the conveying-in of the succeeding sheet P2 is smoothly conducted.

(5) Preceding Sheet Conveying-out Process:

The stopping member 131 to the third position V3 in which the upper end (leading edge in the conveying-out direction) of the preceding sheet P1 reaches a nip of the drive roller 122 and the follower roller 123, and the drive roller is rotated clockwise and the preceding sheet is conveyed out. The condition that the stopping member 131 is elevated to the third position, is shown in FIG. 11. The third position, that is, in the stage in which the upper end (leading edge in the conveying-out direction) of the preceding sheet P1 is nipped between the drive roller 122 and the follower roller 123, the stopping member 131 is lowered to the first position V1.

The conveying-in of the succeeding sheet P2 of the above (4) and the conveying-out of the preceding sheet P1 of the above (5) are conducted in superimposition with each other temporally. That is, by the clockwise rotation of the drive roller 122, the conveying-in of the succeeding sheet P2 and the conveying-out of the preceding sheet P1 are simultaneously conducted. Accordingly, the preceding sheet P1 and the succeeding sheet P2 are conveyed in the mode in which they pass each other in the accommodation member of the guide plates 125 and 126. At the time point at which the upper end of the preceding sheet P1 is nipped by the drive roller 122 and the follower roller 123, the stopping member 131 is lowered, and at the time point at which the upper end of the succeeding sheet P2 is separated from the drive roller 122 and the follower roller 123, because the stopping member 131 is in the first position, the succeeding sheet P2 is in a condition that the process of the conveying-in of the above (1) preceding sheet which is separated from the conveying-in means, is completed.

Because the above-described alignment processing and punch processing are conducted in the reversal conveying section 13, the alignment can be conducted without lowering the conveying efficiency, and the high speed processing or sheet delivery in the finisher B is smoothly conducted, and the aligned documents are accumulated on the sheet delivery tray.

Particularly, because the stapling processing or folding processing is conducted on the aligned sheets, the stapling processing or folding processing is smoothly conducted, and the good finished stapling processed or folding processed document is made.

Shift Processing

Figure 13:
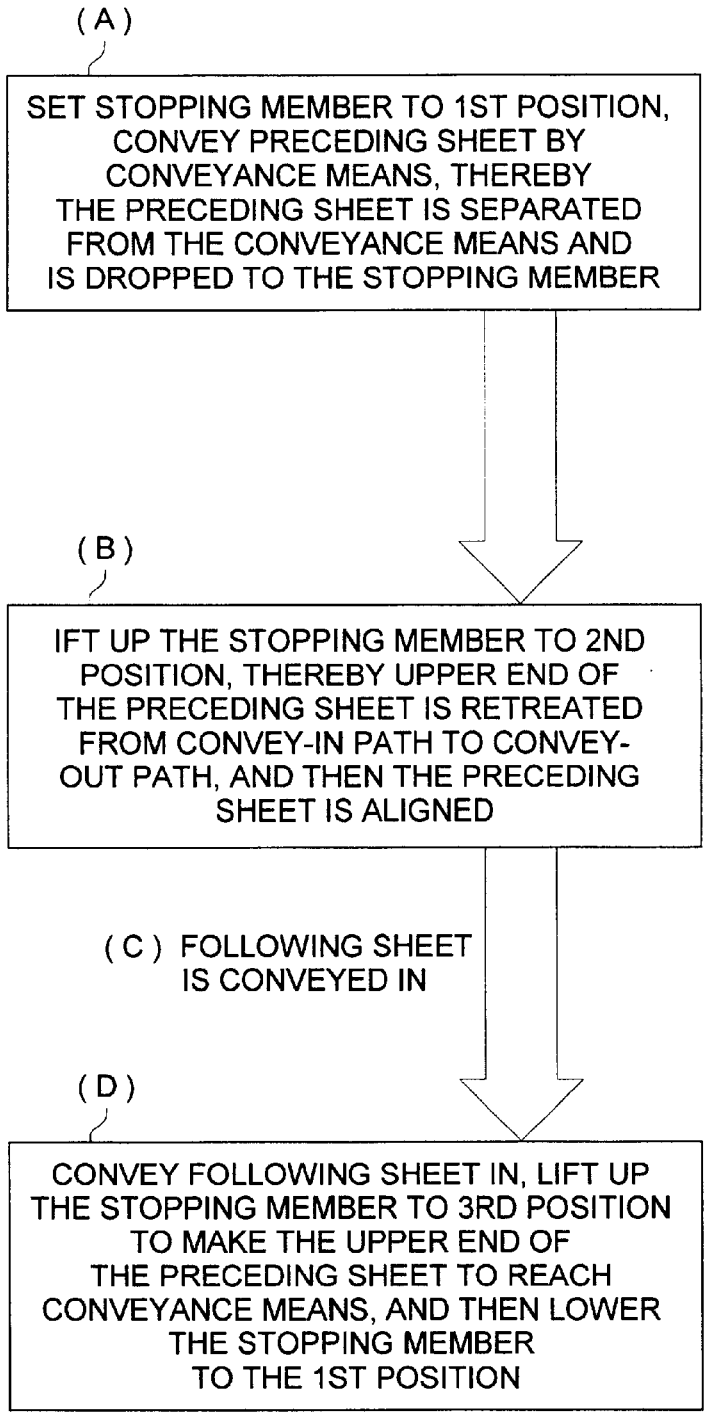
FIG. 13 is a view showing a process of a shift processing.

Next, referring to FIGS. 2–4, 6, 8, 10(*a*)–13, the shift processing will be described. FIGS. 12(*a*) and 12(*b*) show the shift operation, and FIG. 13 shows the process of the shift processing.

The shift processing is a processing in which, for example, when the copy or print of a plurality of volumes is conducted, the sheets are displaced in the conveying path width direction for each volume, and the sheets are sorted for each volume and delivered onto the sheet delivery tray.

In the present embodiment, the shift processing is conducted when the regulation member 13A is displaced for each volume from the position of FIG. 12(*a*) to the position of FIG. 12(*b*) . In this connection, in the example of the shift processing which will be described below, the sheet delivery in which the sheets are displaced in the conveying path width direction, and the sheet delivery in which the sheets are not displaced, are combined, but the shift processing in which, the sheet delivery in which the sheets are displaced in one direction, and the sheet delivery in which the sheets are displaced in the opposite direction, are combined, may be conducted.

(A) Preceding Sheet Conveying-in Process:

The drive roller 122 is rotated clockwise and the sheet P1 is conveyed in from the conveying-in path 10B. In the preceding sheet conveying-in process, the stopping member 131 is set to the lowest first position V1 when the upper end (trailing edge in the conveying-in direction) of the sheet P1 is separated from the follower roller 121 and the drive roller 122, and because the sheet P1 is separated from the drive roller 122 and the follower roller 121, the sheet P1 drops and is supported by the stopping member 131 and stops. FIG. 6 shows the stage in which the conveying-in process is completed.

(B) Preceding Sheet Withdrawal Process, Shift Process:

The stopping member 131 is elevated to the second position V2, that is, a position in which the upper end (trailing edge in the conveying-in direction) of the sheet is in an upper position than the guide end Q of the protrusion 124. In this elevation process of the stopping member 131, the upper end of the sheet P1 is, because the guide end Q of the protrusion 124A is positioned on the side of the conveying-in path 10B from the vertical line L, surely withdrawn from the conveying-in path 10B to the conveying-out path 10C.

A condition that the stopping member 131 is elevated to the second position, is shown in FIG. 8. In the condition of FIG. 8, the shift processing by which the sheet P1 is displaced in the conveying path width direction, is conducted. Mainly, the shift processing will be described by FIGS. 10(*a*) and 10(*b*) which is a sectional view along the line 6–6 in FIG. 6.

The regulation members 13A and 13B are respectively driven by pins 230A and 230B and set to a position of FIG. 12(*a*) and a position of FIG. 12(*b*). The pin 230A is fixed to the toothed belt 235 trained around the follower roller 233A and the drive roller 233B, and fixed to the regulation member 13A. The pin 230B is fixed to the toothed belt 235 in the side portion opposite to the combination side portion of the pin 230A of the toothed belt 235, and the regulation member 13B is engaged with the regulation member 13B through the longitudinal log hole 230C, and lateral long hole 230D. The toothed belt 235 is moved as shown by a sold arrow in the drawing, by being driven by the stepping motor M3 in the shift process.

The regulation member 13B can move upward and downward as shown in FIG. 10(*b*), and in the shift process, it is set to an elevation position shown by a dotted line in FIG. 10(*b*), and the pin 230B is positioned in the lateral long hole 230D.

In the shift process, when the toothed belt 235 is driven by the stepping motor M3 and moved as shown by a solid line arrow, the regulation member 13A is moved from a position of FIG. 12(*a*) to a position of FIG. 12(*b*), but the regulation member 123B is not moved. By such the movement of the regulation member 123A, the sheet is displaced from the position of Pa to the conveying path width direction and positioned at the position Pb.

For example, when a plurality of volumes of documents composed of 5 sheets are made, the 5 sheets are conveyed and processed at the position of Pa, and next 5 sheets are displaced to the position of Pb, and the shift processing to convey the sheet is alternately conducted.

In this connection, the movement range at the time of shift processing of the regulation members 13A and 13B is set to a range in accordance with the sheet size by the control of the stepping motor M3. Further, for each of the plurality of sheets, the sheets are moved in the opposite direction and the shift processing may also be conducted.

Which one of the withdrawal process to elevate the above stopping member 131 to the second position V2, and the shift process may be conducted earlier, or simultaneously conducted.

(C) Succeeding Sheet Conveying-in Process (Stage S3):

After the withdrawal from the conveying-in path 10B of the preceding sheet by the elevation of the stopping member 131 to the second position V2 and the alignment, the conveying-in of the succeeding sheet P2 is conducted. That is, by the clockwise rotation of the drive roller 122, the succeeding sheet P2 is conveyed in. In the conveying-in process, because the upper end (leading edge in the conveying direction) of the preceding sheet P1 is withdrawn from the conveying-in path, described above, the conveying-in of the succeeding sheet P2 is smoothly conducted.

(D) Preceding Sheet Conveying-out Process (Stage S4):

The stopping member 131 is elevated to the third position V3 in which the upper end (leading edge in the conveying-out direction) of the preceding sheet P1 reaches the nip between the drive roller 122 and the follower roller 123, and the drive roller 122 is rotated clockwise and the preceding sheet P1 is conveyed out. A condition that the stopping member 131 is elevated to the third position V3, is shown in FIG. 11. At the third position V3, that is, at the stage at which the upper end (leading edge in the conveying-out direction) of the preceding sheet P1 is nipped between the drive roller 122 and the follower roller 123, the stopping member 131 is lowered to the first position V1.

The conveying-in of the succeeding sheet P2 of (C) and the conveying-out of the preceding sheet P1 of (D) are conducted in overlapping with each other temporarily. That is, by the clockwise rotation of the drive roller 122, the conveying-in of the succeeding sheet P2 and the conveying-out of the preceding sheet P1 are conducted simultaneously. Accordingly, the preceding sheet P1 and the succeeding sheet P2 are conveyed in a mode in which they pass each other in the accommodation member of the guide plates 125 and 126. At the time point at which the upper end of the preceding sheet P1 is nipped between the drive roller 122 and the follower roller 123, the stopping member 131 is lowered and at the time point at which the upper end of the succeeding sheet P2 is separated from the drive roller 122 and the follower roller 123, the stopping member 131 is in the first position V1, therefore, the succeeding sheet P2 is in the condition (stage S5) that the conveying-in process of the preceding sheet shown in above (A) which is separated from the conveying-in means, is completed.

Folding Processing

Referring to FIGS. 14(*a*), 14(*b*), 15(*a*)–15(*f*), the folding processing will be described. Respectively, FIGS. 14(*a*) ands 14(*b*) show the structure of folding sections 14 and 15, and FIGS. 15(*a*)–15(*f*) show a process of three fold processing (Z-fold processing) by which two portions of the sheet P are folded.

The folding section 14 shown in FIG. 14(*a*) is structured by folding rollers 141, 142 as the drive roller, the follower rollers 143 and 144 which are respectively in contact with these folding rollers and driven, and the guide member 145. The folding roller 141 are displaceable as will be described later.

The folding section 15 shown in FIG. 14(*b*) is structured by folding rollers 151, 152 as the drive roller, the follower rollers 153 and 154 which are respectively in contact with these folding rollers and driven, and the guide member 155. The folding roller 151 are displaceable as will be described later.

In the folding mode, the fold processing is conducted in such a manner that, to the sheet P by the folding section 14, for example, the first fold processing is conducted at a position of ¼ from its leading edge, and further, the fold processing is conducted by the folding section 15 at a position of ¼ (¼ of the entire length of the sheet) from the leading edge of the folded sheet P, and the sheet P is, for example, Z-fold processed.

In FIG. 15(*a*), in the condition that the folding roller 141 and the folding roller 142 are separated from each other and the follower rollers 143 and 144 are respectively in pressure-contact with the folding rollers 141 and 142, the sheet p is conveyed and introduced into the folding section 14. In the stage in which the sheet P is conveyed by a predetermined distance D from the reference position R, by the sheet leading edge detection signal of a sensor SS2, the drive of the folding rollers 141 and 142 is stopped, and the sequence transfers to the folding process in FIG. 15(*b*).

In FIG. 15(*b*), after the folding roller 141 and follower roller 143 are displaced and the folding roller 141 and the folding roller 142 are in pressure-contact with each other, the folding roller 141 is rotated in the same direction as that at the time of the introduction, and the folding roller 142 is rotated in the opposite direction to that at the time of introduction and the folding is started. By the conveying operation in the opposite direction of the folding rollers 141 and 142 for the sheet P, the sheet P is bent and the fold of the sheet P enters between the folding roller 141 and the folding roller 142. In this connection, there is provided the guide member 145 having the protrusion 145A as shown in FIG. 14(*a*) by which the bent of the sheet P onto the folding rollers 141 and 142 side is surely conducted. Further, as in FIG. 15(*c*), the folding is conducted by continuously conducting the rotation of the folding rollers 141 and 142, and the folded sheet P is conveyed by the conveying roller 210 and introduced into the folding section 15.

As shown in FIG. 15(*d*), the folding rollers 151 and 152 of the folding section 15 are separated from each other, and under the condition that the follower roller 153 and the follower roller 154 are respectively in pressure-contact with the folding rollers 151 and 152, the sheet P is introduced, and in the stage that leading edge of the folded sheet P is conveyed by a predetermined distance D from the reference position R, the folding roller 151 is displaced according to the sheet leading edge detection signal of the sensor SS3, and is pressure-contacted with the folding roller 152. After the pressure-contact, the folding roller 151 is rotated in the same direction as that at the time of the introduction, and the folding roller 152 is rotated in the opposite direction to that at the time of the introduction. By the conveying operation in the opposite direction of the folding rollers 151 and 152 for the sheet P, the sheet P is bent, and the fold enters between the folding roller 151 and the folding roller 152. In this connection, there is provided the guide member 155 having the protrusion 155A as shown in FIG. 14(*b*) to surely conduct the bent of the sheet P to the folding rollers 151 and 152 side. As in FIG. 15(*e*), the sheet P is folded by reversing the rotation direction of the folding roller 152 after the pressure-contact. As in FIG. 15(*f*), while the rotation of the folding rollers 151 and 152 is continued, and the sheet P is folded, the sheet P is delivered from the folding section 15 and conveyed to the conveying path 10.

In the example of FIGS. 15(*a*)–15(*f*), the folding is conducted at the position of ¼ from the leading edge of the sheet P. The sensor SS2 and SS3 respectively detect the leading edge of the sheet P at the reference position, that is, at D=¼×LT (LT is the length in the conveying direction of the sheet P) from the position shown by the tangential line of the outer periphery of folding rollers 141 and 142 and the position shown by the tangential line of the outer periphery of folding rollers 151 and 152. Actually, the delay of the reversing time of the folding rollers 141, 142, 151, and 152 is considered, and the position is set to a little shorter distance than ¼×LT.

The sensors SS2 and SS3 are set to various positions according to a folding mode in the sheet P or the sheet size.

As shown in the drawing, in a process in which the fold processing is conducted at two portions of the sheet P, the sheet P is introduced into the folding section 14 from the direction Z1, and conveyed and sent from the folding section 14 into the folding section 15 in the almost perpendicular direction Z2 to the direction Z1. The sheet P which is fold processed in the folding section is conveyed in almost perpendicular direction Z3 to the direction Z2, that is, in almost the same direction Z3 as the direction Z1.

According to the Structure (1), because the punch processing is conducted in the reversal conveying process, without the case where the sheet conveying is stopped or the conveying speed is lowered in the main conveying path, the punch processing is conducted. Accordingly, the punch processing can be conducted without the case where the conveying speed of the sheet in the image forming apparatus or sheet finisher is lowered, and the assembling of the sheet puncher into the high speed sheet finisher or high speed image forming apparatus becomes possible.

According to the Structure (2), the punch processing to make a hole at a correct position of the sheets, is conducted. Moreover, because the alignment processing is conducted in the reversal conveying section, the sheets can enough aligned without lowering the conveying speed, and the correct punch processing is conducted even in the high speed processing.

According to the Structure (3), (4) or (5), because the sheets are conveyed by passing by each other in the reversal conveying section, the sheet interval can be shorten and the high speed processing becomes possible.

According to the Structure (6), the punch processing is conducted on various sized sheets at an appropriate position.

According to the structure (7), the sheet finisher equipped with the puncher having the high speed processing ability is realized.

According to the Structure (8), the image forming apparatus equipped with the puncher having the high speed processing ability is realized.

What is claimed is:

1. A sheet puncher comprising:

(a) a reversal conveying section having a displaceable stopping member for stopping a sheet at a predetermined position representing a bottom position, the stopping member being movable to an intermediate position or a top position, and a punching device for punching the sheet; and (b) a conveying-in and conveying out section having a conveying-in device and a conveying-out device for conveying-in the sheet from a main conveying path into the reversal conveying section, and conveying-out the sheet from the reversal conveying section to the main conveying path, wherein the conveying-in device (1) conveys a first sheet into the reversal conveying section and the stopping member stops the first sheet at the predetermined position, the stopping member (2) moves to the intermediate position to move up the first sheet, then the punching device (3) punches the first sheet, the conveying-in device (4) conveys a second sheet following the first sheet into the reversal conveying section, the stopping member (5) moves to the top position at which the conveying-out device (6) conveys the first sheet from the reversal conveying section while the conveying-in device continues to convey the second sheet, further the stopping member (7) moves down to the predetermined position while the conveying-out device continues to convey the first sheet and the conveying-in device further continues to convey the second sheet, and thereafter the operations of (1) to (7) are performed on a third sheet onward following the second sheet.

2. The sheet puncher of claim 1, wherein the reversal conveying section further has an alignment device for aligning both ends in a width direction of the sheet, and after the alignment device aligns the sheet, the punching device punches the sheet.

3. The sheet puncher of claim 1, wherein the conveying-in and conveying-out section further have a conveying-in path, a conveying-out path, and a guiding member, and wherein the guiding member guides a trailing edge in a conveying-in direction of the sheet from the conveying-in path to the conveying-out path after the stopping member stops the sheet.

4. The sheet puncher of claim 3, wherein when a preceding sheet exists in the reversal conveying section, and after the guiding member guides the trailing edge in the conveying-in direction of the preceding sheet to the conveying-out path, the conveying-in device conveys a succeeding sheet into the reversal conveying section.

5. The sheet puncher of claim 3, wherein the stopping member is displaced such that the trailing edge in the conveying-in direction of the sheet is moved to the conveying-out path, and the punching device punches the sheet after the stopping member has been displaced.

6. The sheet puncher of claim 1, wherein the punching device is displaced in accordance with a size of the sheet.

7. A sheet finisher comprising:

a sheet puncher comprising:

(a) a reversal conveying section having a displaceable stopping member for stopping a sheet at a predetermined position representing a bottom position, the stopping member being movable to an intermediate position or a top position, and a punching device for punching the sheet; and (b) a conveying-in and conveying out section having a conveying-in device and a conveying-out device for conveying-in the sheet from a main conveying path into the reversal conveying section, and conveying-out the sheet from the reversal conveying section to the main conveying path, wherein the conveying-in device (1) conveys a first sheet into the reversal conveying section and the stopping member stops the first sheet at the predetermined position, the stopping member (2) moves to the intermediate position to move up the first sheet, then the punching device (3) punches the first sheet, the conveying-in device (4) conveys a second sheet following the first sheet into the reversal conveying section, the stopping member (5) moves to the top position at which the conveying-out device (6) conveys the first sheet from the reversal conveying section while the conveying-in device continues to convey the second sheet, further the stopping member (7) moves down to the predetermined position while the conveying-out device continues to convey the first sheet and the conveying-in device further continues to convey the second sheet, and thereafter the operations of (1) to (7) are performed on a third sheet onward following the second sheet.

8. An image forming apparatus comprising:

a sheet puncher comprising:

(a) a reversal conveying section having a displaceable stopping member for stopping a sheet at a predetermined position representing a bottom position, the stopping member being movable to an intermediate position or a top position, and a punching device for punching the sheet; and (b) a conveying-in and conveying out section having a conveying-in device and a conveying-out device for conveying-in the sheet from a main conveying path into the reversal conveying section, and conveying-out the sheet from the reversal conveying section to the main conveying path, wherein the conveying-in device (1) conveys a first sheet into the reversal conveying section and the stopping member stops the first sheet at the predetermined position, the stopping member (2) moves to the intermediate position to move up the first sheet, then the punching device (3) punches the first sheet, the conveying-in device (4) conveys a second sheet following the first sheet into the reversal conveying section, the stopping member (5) moves to the top position at which the conveying-out device (6) conveys the first sheet from the reversal conveying section while the conveying-in device continues to convey the second sheet, further the stopping member (7) moves down to the predetermined position while the conveying-out device continues to convey the first sheet and the conveying-in device further continues to convey the second sheet, and thereafter the operations of (1) to (7) are performed on a third sheet onward following the second sheet.

* * * * *